US007246846B2

(12) United States Patent
Shioji et al.

(10) Patent No.: US 7,246,846 B2
(45) Date of Patent: Jul. 24, 2007

(54) CAB FOR CONSTRUCTION MACHINE

(75) Inventors: Hiroyuki Shioji, Komatsu (JP); Akihide Namura, Hirakata (JP); Tatsushi Itoh, Hirakata (JP)

(73) Assignee: Komatsu Ltd., Tokyo (JP)

( * ) Notice: Subject to any disclaimer, the term of this patent is extended or adjusted under 35 U.S.C. 154(b) by 474 days.

(21) Appl. No.: 10/806,407

(22) Filed: Mar. 23, 2004

(65) Prior Publication Data

US 2005/0006157 A1 Jan. 13, 2005

(30) Foreign Application Priority Data

Apr. 10, 2003 (JP) ..... 2003-106072

(51) Int. Cl.
*B60R 21/13* (2006.01)
*B62D 33/06* (2006.01)

(52) U.S. Cl. ..... 296/190.11; 296/190.08; 296/102; 180/89.12; 280/756

(58) Field of Classification Search ..... 296/190.08, 296/190.11, 155, 1.02, 187.13, 193.11; 180/89.12; 280/756
See application file for complete search history.

(56) References Cited

U.S. PATENT DOCUMENTS

| | | | | |
|---|---|---|---|---|
| 4,600,236 | A * | 7/1986 | Weiss et al. | 296/190.03 |
| 5,042,835 | A * | 8/1991 | Burns | 280/756 |
| 5,577,795 | A | 11/1996 | Shinsen | |
| 5,779,272 | A * | 7/1998 | Panek et al. | 280/756 |
| 6,149,228 | A * | 11/2000 | O'Neill et al. | 296/190.03 |
| 6,325,449 | B1 * | 12/2001 | Sorensen et al. | 296/190.08 |
| 6,485,084 | B2 * | 11/2002 | Sorensen et al. | 296/102 |
| 6,543,840 | B2 * | 4/2003 | Colliar et al. | 296/190.08 |
| 6,561,572 | B1 * | 5/2003 | Martin, Jr. | 296/190.1 |
| 6,611,990 | B1 * | 9/2003 | Sogo et al. | 16/87 R |
| 6,772,544 | B2 * | 8/2004 | Takemura et al. | 37/347 |
| 6,799,353 | B1 * | 10/2004 | Stewart | 16/422 |
| 6,810,980 | B2 * | 11/2004 | Jo et al. | 180/89.13 |
| 2001/0054832 | A1 * | 12/2001 | Mizuta | 296/205 |

FOREIGN PATENT DOCUMENTS

| | | | |
|---|---|---|---|
| EP | 1 380 497 | A2 | 1/2004 |
| JP | 11-93216 | A | 4/1999 |
| JP | 11-229439 | A | 8/1999 |
| JP | 2000-96625 | A | 4/2000 |
| JP | 2001-049696 | | 2/2001 |
| JP | 2002-088812 | | 3/2002 |
| JP | 2002-88813 | A | 3/2002 |
| JP | 2002-250052 | A | 9/2002 |
| JP | 2003-268806 | A | 9/2003 |

* cited by examiner

*Primary Examiner*—D. Glenn Dayoan
*Assistant Examiner*—Greg Blankenship
(74) *Attorney, Agent, or Firm*—Posz Law Group, PLC; R. Eugene Varndell, Jr.

(57) ABSTRACT

A cab capable of easily securing rollover protection strength at low manufacturing cost is offered. Four pillars are mounted in the front and rear, and left and right of the cab. Two of them are mounted respectively in a first position at the outer side portion where it bulges outward and in a second position on the inner side portion and opposite the first position in the left-and-right direction. At least one of the pillars is formed with a pipe. A U-shaped frame is firmly mounted between the upper ends of the left and right rear pillars among the four pillars, and directed rearward to form a U-shaped rear roof frame.

7 Claims, 9 Drawing Sheets

CAB FOR CONSTRUCTION MACHINE

BACKGROUND OF THE INVENTION

1. Field of the Invention

The present invention relates to a cab for a construction machine.

2. Description of the Related Art

Small-sized hydraulic shovels conventionally frequently used in civil engineering works, or truck cranes often used for assembling steel structures of small buildings in urban areas, must be operated in narrow places. Therefore, a turntable is mounted at the upper portion of the traveling gear. A working machine such as a shovel machine or crane machine is disposed on the turntable. An operator's cab (hereinafter simply referred to as the cab) is disposed at a position offset left or right from the working machine. The operator can get an unobstructed view of the front-end portion of the working machine. Furthermore, the cab is so designed not to protrude outside the radius of rotation of the outer fringes of the turntable. In this way, considerations are given not to interfere with surrounding structures and so on Its first example is Patent Reference 1 (JP-A-2002-88812), for example. The following construction is shown in its page 3 and FIGS. 1, 3, 9, and 10: A cab is mounted offset left from a working machine. The cab is a slim and substantially rectangular parallelepiped except that the front window is tilted. Pillars are mounted at the four corners. An intermediate pillar is mounted in the outer side surface (in this case, left side surface), and an outwardly opening door is mounted to the intermediate pillar. Thus, a simple structure is constituted. Furthermore, construction details for realizing a decrease in the manufacturing cost are described.

In the above-described structure, however, in a case where the hydraulic shovel or truck crane is small-sized, there is the problem that it is difficult to mount a rectangular parallelepiped cab of necessary size within the radius of rotation of the turntable. Means for solving this is Patent Reference 2 (JP-A-2001-49696), for example. The following construction is described in its pages 5-6 and FIGS. 1-3: The outer side of the cab has a curved surface bulging outward along with the outer end of the rotating radius of the turntable. A sliding door is fitted to the outer side portion. This permits the cab to be positioned within the radius of rotation of the turnrable whether the door is opened or closed, and can secure necessary habitation space within the cab.

In FIGS. 8-10, a hydraulic shovel 70 has a traveling gear 71 the top portion on which is mounted a turntable 72 rotatably. A working machine 75 is mounted on the turntable 72. A cab 73 is disposed at a position offset left from the working machine 75. An engine compartment 74 is disposed immediately behind the cab 73.

The cab 73 has an inner side surface portion 78 and a rear surface portion 79 comprising vertical planes. A front surface portion 76 has a lower portion 76*a* comprising a vertical plane and an upper portion 76*b* comprising a rearwardly tilting plane. An outer side surface portion 80 is formed by a curved surface bulging outward substantially along the outer end of the rotating radius of the turntable. The outer side surface portion 80 has a front lower portion 80*b* that is a cylindrical, two-dimensionally curved surface and a front upper portion 80*a* that is a three-dimensionally curved surface having as its base end the cylindrical surface of the front lower portion 80*b*. The radius of curvature of this three-dimensionally curved surface decreases from the base end upwardly in step with the rearward tilting of the front upper portion 80*a*. A rear portion 91 is cylindrical, a two-dimensionally curved surface having a radius of curvature smaller than that of the upper-end portion of the front upper portion 80*a*.

The outer side surface portion 80 has a front-end portion, a rear-end portion, and an intermediate portion in which a front pillar 82, a rear pillar 83, and an intermediate pillar 81 are respectively disposed. A sliding door 86 is disposed in an entrance opening 84 between the front pillar 82 and intermediate pillar 81. The surface of the sliding door 86 is shaped to conform with the curvature of the front lower portion 80*b* and front upper portion 80*a* of the outer side surface portion 80 of the cab 73. Rollers (not shown) mounted inside the top and bottom of the front-end portion of the sliding door 86 and rollers (not shown) mounted toward the center and inside the top and bottom of the rear-end portion of the sliding door 86 are engaged over guide rails 89, 90, and 85, respectively. This permits the sliding door 86 to be slidable along the outer side surface portion 80 of the cab 73.

In the construction shown in FIGS. 8-10, the radius of curvature of the cylindrical, two-dimensionally curved surface of the rear portion 91 of the outer side surface portion 80 of the cab 73 is made smaller than that of the upper-end portion of the front upper portion 80*a*. Consequently, the sliding door 86 can slide while in almost complete contact with the outer side surface portion 80 of the cab 73. Accordingly, when the sliding door 86 is opened, the door 86 does not protrude outside the radius of curvature of the outer fringes of the turntable 72. Furthermore, a large indoor space can be secured in the cab 73.

However, the prior art cab disclosed in Patent Reference 2 has the following problems.

(1) The cab 73 has the four pillars at the four corners (i.e., front, rear, left, and right corners) and has one pillar at the bulging portion of the outer side surface portion 80 (only outer pillars 81, 82, and 83 are shown). Therefore, there are many pillars. The structure is complex. Consequently, the manufacturing cost is high.

(2) In spite of having the five pillars, only one intermediate pillar 81 is present in the center of the cab 73. Where the cab 73 of this structure is so constructed that when the hydraulic shovel 70 rolls over, the cab is strong enough to withstand the crush and secure a required space inside (hereinafter referred to as the rollover protection strength) it is necessary to reinforce all of the pillars at the four corners of the cab 73 and beams connecting top portions of the pillars (only outer beam 87 is shown). Hence, the manufacturing cost of the cab is quite high.

(3) Another conceivable method to give the cab a structure having rollover protection strength comprises mounting a separate gate-shaped rollover guard across the cab. In this case, however, the cost of the rollover guard is produced. In addition, there arises the problem that the rollover guard protrudes outside the radius of rotation of the turntable 72. That is, it is required that the cab and rollover guard be contained within the radius of rotation of the turntable.

SUMMARY OF THE INVENTION

The present invention has been made in light of the foregoing problems. It is an object of the invention to provide a construction machine's cab that can be manufactured at low cost and can easily secure rollover protection strength.

To achieve the above-described object, a first invention provides a cab for a construction machine having a traveling gear and a turntable rotatably mounted on top of the traveling gear, the cab being fitted with a sliding door at the outer side and having a curved surface bulging outward, the door being mounted in a position offset from the center of rotation of the turntable. The cab has four pillars, at the front and rear, and left and right. Two of these pillars are mounted respectively in a first position at the outer side portion where it bulges outward, and a second position on the inner side surface portion at the position opposite to the first position in the left-and-right direction.

This invention produces the following effects. Among the four pillars of the cab (at the front and rear, and left and right) is a pillar. (hereinafter referred to as the outer central pillar) mounted in the outer side surface portion where it bulges outward, and the pillar (hereinafter referred to as the inner central pillar) mounted on the inner side surface portion opposite to the position of the former pillar in the left-and-right direction. Accordingly, the sliding door can be mounted without providing the prior art intermediate pillar. This simplifies the structure. A cost reduction can be accomplished. Furthermore, the four (front and rear, and left and right) pillars can form a box structure. In addition, pillars are mounted at the outer side surface portion where it bulges outwardly and in the opposite position in the left-and-right direction, considering that the portion bulging outwardly is most likely to receive great external force when the construction machine rolls over. In consequence, a cab of the structure having rollover protection strength can be constructed.

A gate-shaped frame can be formed by connecting top portions of the outer central pillar and the inner central pillar by a beam. This produces the same effect as produced where a rollover guard is disposed around the longitudinal center of the cab. As a result, crush withstanding strength of the cab when the construction machine rolls over can be improved greatly at low cost.

In a second invention, at least any one of the four pillars is made of a pipe. According to this invention, the pillar in a desired position is made of the pipe and thus the strength of this portion can be improved. For example, if both the outer central pillar and inner central pillar are made of a rigid pipe, and if the top portions of these two pillars are coupled by a beam made of a rigid pipe, a rigid gate-shaped rollover guard can be formed around the longitudinal center of the cab. In consequence, the crash-resistant strength of the cab when the construction machine rolls over can be improved further.

For example, the outer central pillar, the inner central pillar, and the beams connecting the top portions of both pillars may be fabricated from pipes. The strength of the pipe can be selected to correspond to the mass of the construction machine. Accordingly, the strength of the cab can be so set that when the construction machine rolls over, crushing is avoided and the necessary space can be secured inside. As a result, a cab having rollover protection strength can be easily constructed.

In a third invention, the pipe for each pillar is of special cross section. According to this invention, each pillar is made of a pipe which is fabricated by rolling a round or rectangular pipe into a desired cross-sectional shape. This makes it possible to directly attach a window pane or the like to the pillars, for example. As a result, the external appearance of the dab can be improved. Also, the manufacturing cost can be reduced.

In a fourth invention, the pillars form a rollover protection system (ROPS) that protects the operator when the construction machine rolls over. This assures that the operator is protected in case of a rollover.

In a fifth invention, a U-shaped frame directed rearward is rigidly mounted between the upper-end portions of the rear left and right pillars of the four pillars. Thus, a U-shaped rear roof frame is formed. According to this invention, the roof portion in the rear portion of the cab is also reinforced and so the crash-resistant strength of the rear portion of the cab when the construction machine rolls over can be improved. This reduces deformation of the cab when the construction machine rolls over. A wide space can be secured within the cab with greater certainty.

In a sixth invention, the outer pillar in front of the front-end of the outer side is made of a pipe. The upper-end portion of the outer front pillar is bent rearward in a two-dimensional manner to form a beam portion. In this structure, the rear end of the beam portion is coupled to the upper-end of the pillar mounted in the first position at the portion of the outer side bulging outward via other beam members. According to this invention, the following effects are obtained.

(1) The pillar in the front-end portion (outer front pillar) and the pillar (outer central pillar) mounted in the position bulging outward are shifted relative to each other in the left-and-right direction by an amount corresponding to the bulge of the outer side surface portion. Accordingly, the rear-end portion of the beam portion formed by bending the upper-end portion of the outer front pillar rearwardly in a two-dimensional manner and the upper-end portion of the outer central pillar are misaligned in the left-and-right direction. A beam member is interposed between them and their end portions are coupled. This simplifies the structure of the pillars. A cost reduction can be accomplished.

(2) Since the rear-end portion of the beam portion, which has been formed by bending the upper-end portion of the outer front pillar rearward in a two-dimensional manner, can be coupled to the beam of the gate-shaped frame formed in the longitudinal center, a rigid three-dimensional frame can be formed. Consequently, a cab having rollover protection strength can be constituted with greater certainty.

A seventh invention is configured so that both end portions of a vertically extending pipe member or rodlike member are mounted in the vicinity of the corner portions where the outer side portion and rear side portion are joined. A stopper member acting when the sliding door opens is mounted to the pipe member or rodlike member. According to this invention, the stopper for the sliding door acts also as a handrail assisting access to and from the construction machine and is mounted near the corner portion between the outer side surface portion of the cab and rear surface portion. Therefore, the whole cab can be made simple in structure. Hence, a cab can be manufactured at low cost.

Because of the results described so far, the cab of the construction machine is fitted with the sliding door in the outer side portion, and has a curved surface that is mounted in a position offset from the center of rotation of the turntable mounted rotatably on the traveling gear, the curved surface bulging outward. The cab can be easily so constructed at low cost that it has rollover protection strength.

DESCRIPTION OF THE PREFERRED EMBODIMENTS

Embodiments of construction machine cabs according to the present invention are hereinafter described in detail with reference to the drawings by taking a hydraulic shovel as an example.

Figure 1:
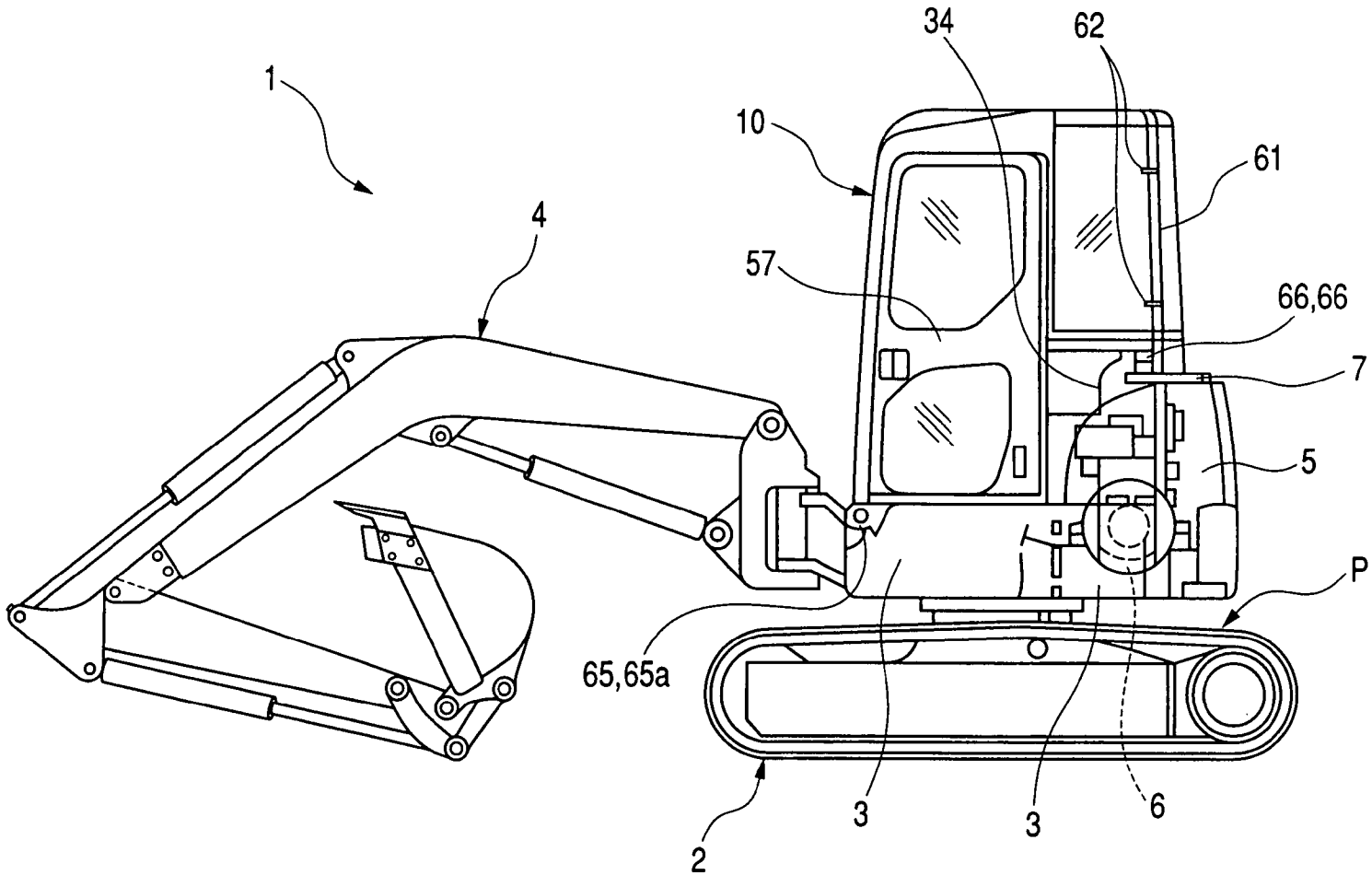
FIG. 1 is a side elevation of a hydraulic shovel to which a cab of the present invention is applied.
Figure 2:
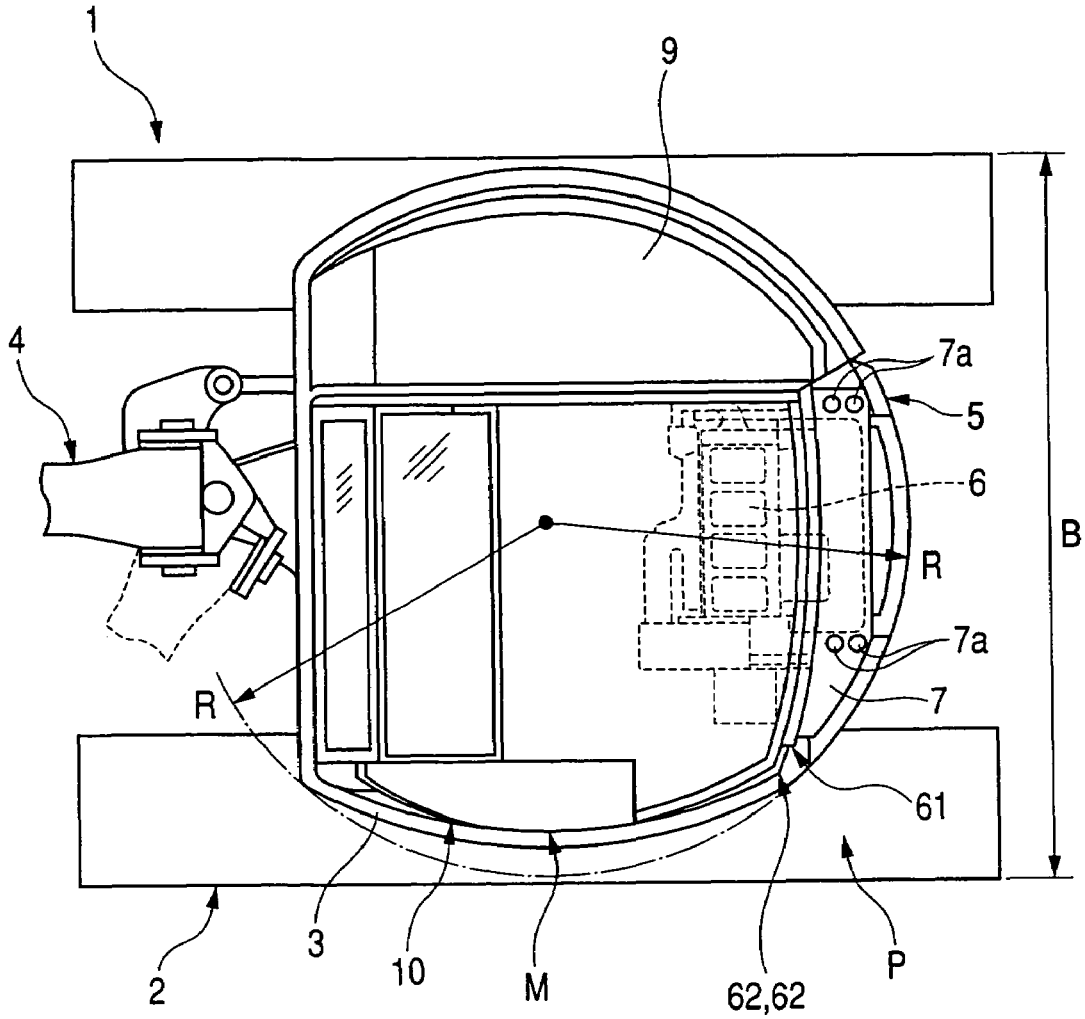
FIG. 2 is a top view of main portions of the hydraulic shovel to which the cab of the invention is applied.

Turning first to FIGS. 1 and 2, a hydraulic shovel 1 has a traveling gear 2 and a turntable 3 rotatably mounted on the top surface of the locomotive body 2. A working machine 4 is mounted to the front portion of the turntable 3. A counter weight 5 is disposed at the rear end of the rear portion of the turntable 3. An engine 6 is disposed adjacent to the front of the counterweight 5. A cab 10 is placed on the left front portion of the turntable 3 so that the operator can get an unobstructed view of the front-end portion of the working machine 4. A machine compartment 9 accommodating a fuel tank, an oil tank for operations, control valves, and so on (not shown) is disposed adjacent to the right side of the cab 10.

Furthermore, in order to secure necessary volume of the cab 10, the rear portion of the cab 10 is first made to extend over the engine 6. The cab 10 has a rear bottom plate 34 acting also as the top surface of the engine 6 and a front shielding plate. The rear portion of the rear bottom plate 34 is supported by a support plate 7 and the counterweight 5 via anti-vibration members 66. Then, the central portion M of the left (hereinafter referred to as the outside) side of the cab 10 is shaped to bulge outward substantially along the outer end of the rotating radius R of the turntable 3. A sliding door 57 is slidably mounted to the front side of the outer side surface portion. Thus, the sliding door 57 is prevented from protruding beyond the radius of rotation R of the turntable 3 whether the door is open or closed. Consequently, a maximum volume is secured in the cab 10 without the cab 10 colliding with any structure adjacent to the machine body of outer width B. The front-end lower portion of the cab 10 is supported by the turntable 3 via Anti-vibration bushings 65 and pins 65*a*, which will be described in detail in FIG. 3.

Figure 3:
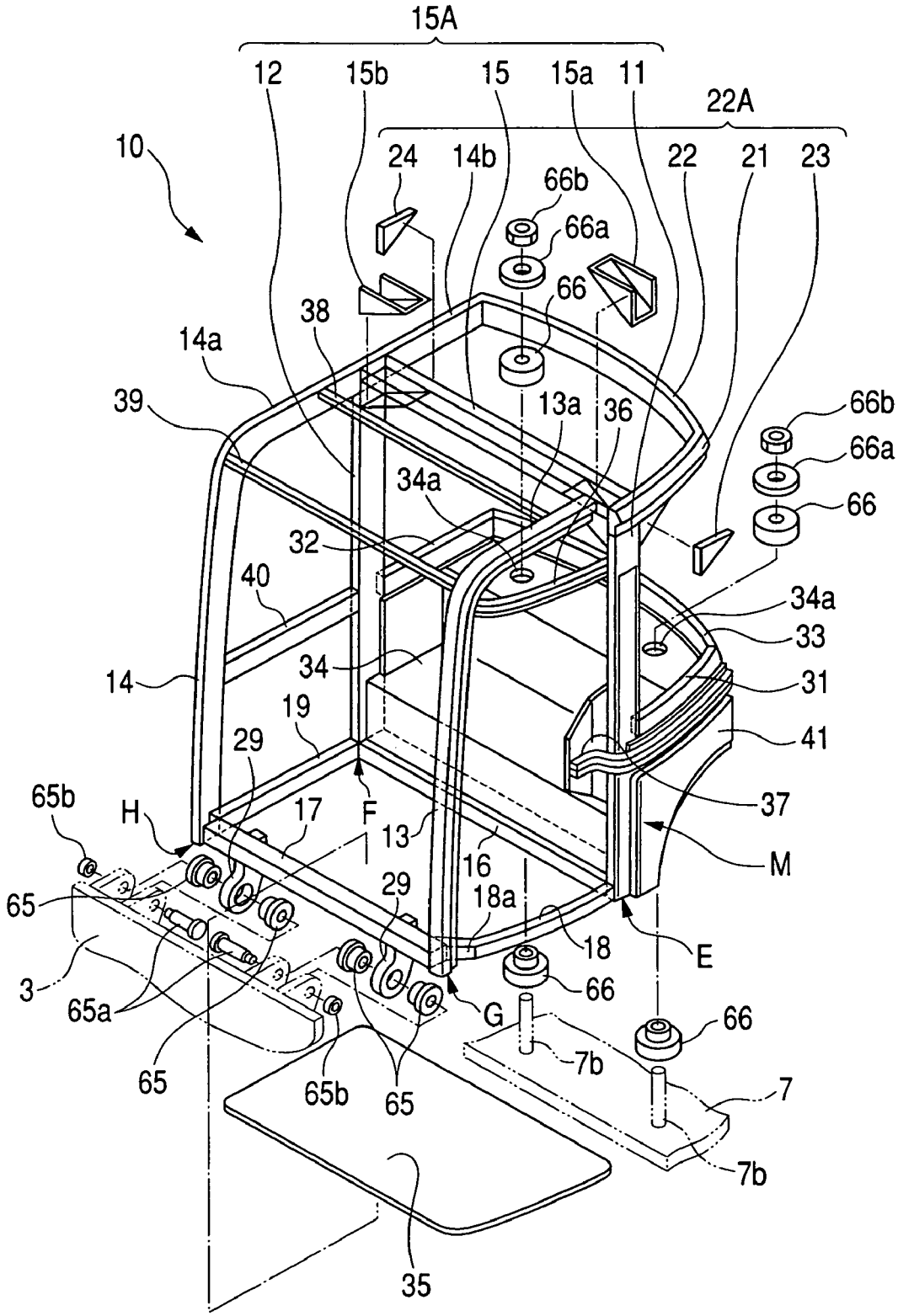
FIG. 3 is a first perspective view illustrating a cab of the invention.

Referring next to FIG. 3, the cab 10 has each of its four pillars made of pipe. That is, there are an outer central pillar 11 mounted in the position of the central portion M of the outer side surface portion, an inner central pillar 12 mounted on the inner side surface portion and located opposite to the pillar 11 in the left-and-right direction of the vehicle, and an outer front pillar 13 and an inner front pillar 14 mounted at the left and right corner portions at the front end of the cab. The upper ends of the outer central pillar 11 and inner central pillar 12 are welded together using a beam 15 made of a pipe and reinforcing members 15*a*, 15*b*. Thus, a gate-shaped rollover guard 15A is formed. The cab is so designed that it secures the cab space within the gate-shaped rollover guard 15A if the vehicle rolls over to thereby protect the operator. In this way, a rollover operator protection system (corresponding to the ROPS structure) is constituted.

Upper portions of the outer front pillar 13 and inner front pillar 14 are bent rearward in a two-dimensional manner to form beam portions 13*a* and 14*a*. Their rear portions are welded to the beam 15 of the rollover guard 15A. Rollover guard 15A, outer front pillar 13, beam portion 13*a*, inner front pillar 14, and beam portion 14*a* together form a rigid three-dimensional frame in the front portion of the cab 10. Lower-end portions of the pillars 11, 12, 13, and 14 are welded to the frames 16, 17, and 19 using the frame 18 and reinforcing member 18*a* for the frame 18, which acts also as a lower guide rail. A floor plate 35 is welded to the top surfaces of the frames 16, 17, 18, and 19. Thus, when an external force is applied to the cab 10, deformation of the cab 10 due to movement of the lower portions of the pillars 11, 12, 13, and 14 is prevented.

A frame 21 and an extension portion 14*b* are made to protrude rearward from the left and right of the top portion of the rollover guard 15A, using reinforcing members 23 and 24. The rear ends of the frame 21 and extension portion 14*b* extending from the beam portion 14*a* are welded together using a frame 22. Frame 21, extension portion 14*b*, and frame 22 together form a U-shaped rear roof frame 22A.

Frames 31 and 32 are welded at left and right intermediate positions on the rollover guard 15A and protrude rearward. Outer casing plates 41 and 42 (see FIG. 4) acting also as ribs are mounted to the frames 31 and 32 by welding. Rear-end portions of the left frame 31, right frame 32, and outer casing plates 41, 42 are welded together using a frame 33 and an outer casing plate 43 (see FIG. 4). The cab 10 has the rear bottom plate 34 mounted inside the frames 31, 32, and 33. The anti-vibration members 66 are fitted in holes 34*a* formed in left and right portions of the rear bottom plate 34, and are tightened against bolts 7*b* of the support plate 7 with washers 66*a* and nuts 66*b*. The support plate 7 is tightened to the top surface of the counterweight 5 by a desired number of bolts 7*a* (see FIG. 2). Bosses 29 are disposed in left and right of the frame 17 in the front portion of the cab. The bosses 29 are made to engage the turntable 3 by the pins 65*a* and nuts 65*b* via anti-vibration bushings 65 sandwiching the bosses 29.

Normally, the cab 10 is supported via the anti-vibration bushings 65 and anti-vibration members 66. When an excessive external force is applied to the cab 10, the anti-vibration bushings 65 and anti-vibration members 66 deform. In this case, the lower-end surfaces E, F, G, and H of the pillars 11, 12, 13, and 14 of the cab 10 directly bear against the turntable 3 (see FIG. 1), whereby the external force can be received and stopped.

Figure 4:
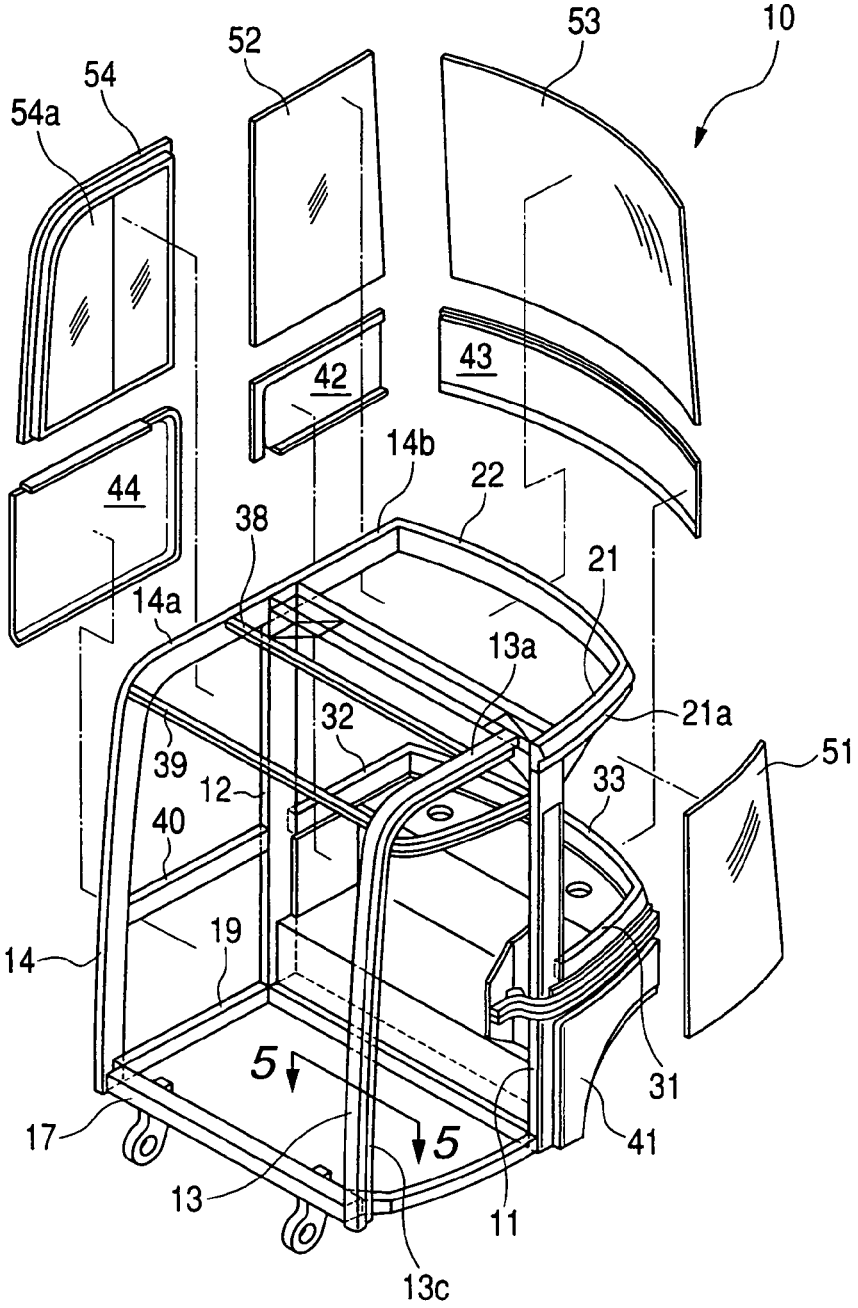
FIG. 4 is a second perspective view illustrating a cab of the invention.
Figure 5:
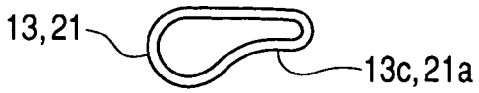
FIG. 5 is a cross section on 5-5 of FIG. 4.

In FIG. 4, the frames 21 of the outer front pillar 13 and outer rear portion are made of round pipes whose cross sections (particularly shown in FIG. 5) have been made to have a special shape by rolling. Thus, surfaces (hereinafter referred to as joining surfaces) 13*c* and 21*a* are formed in a position recessed inwardly stepwise from the outer surface. Adhesive attachment of the windowpane in the joining surfaces 13*c* and 21*a*, fitting of a sash, and abutment of the sliding door 57 can be easily carried out with good aesthetic appearance.

Similarly, joining surfaces (not shown) are formed on the other pillar 14, beam portion 14*a*, extension portion 14*b*, and frame 22. A windowpane 51 is attached between the upper frame 21 and lower frame 31, a windowpane 53 is attached between the upper frame 22 and lower frame 33, and a windowpane 52 is attached between the extension portion 14*b* and frame 32, all with good aesthetic appearance. The spaces between the windowpanes 51, 53, and 52 are sealed with a sealant (not shown) Portions midway up the inner central pillar 12 and inner front pillar 14 are coupled by a cross piece 40. An outer casing plate 44 is welded to the opening below the crosspiece 40. A sash 54 having a windowpane 54*a* is fitted in the opening above the crosspiece 40.

Figure 6:
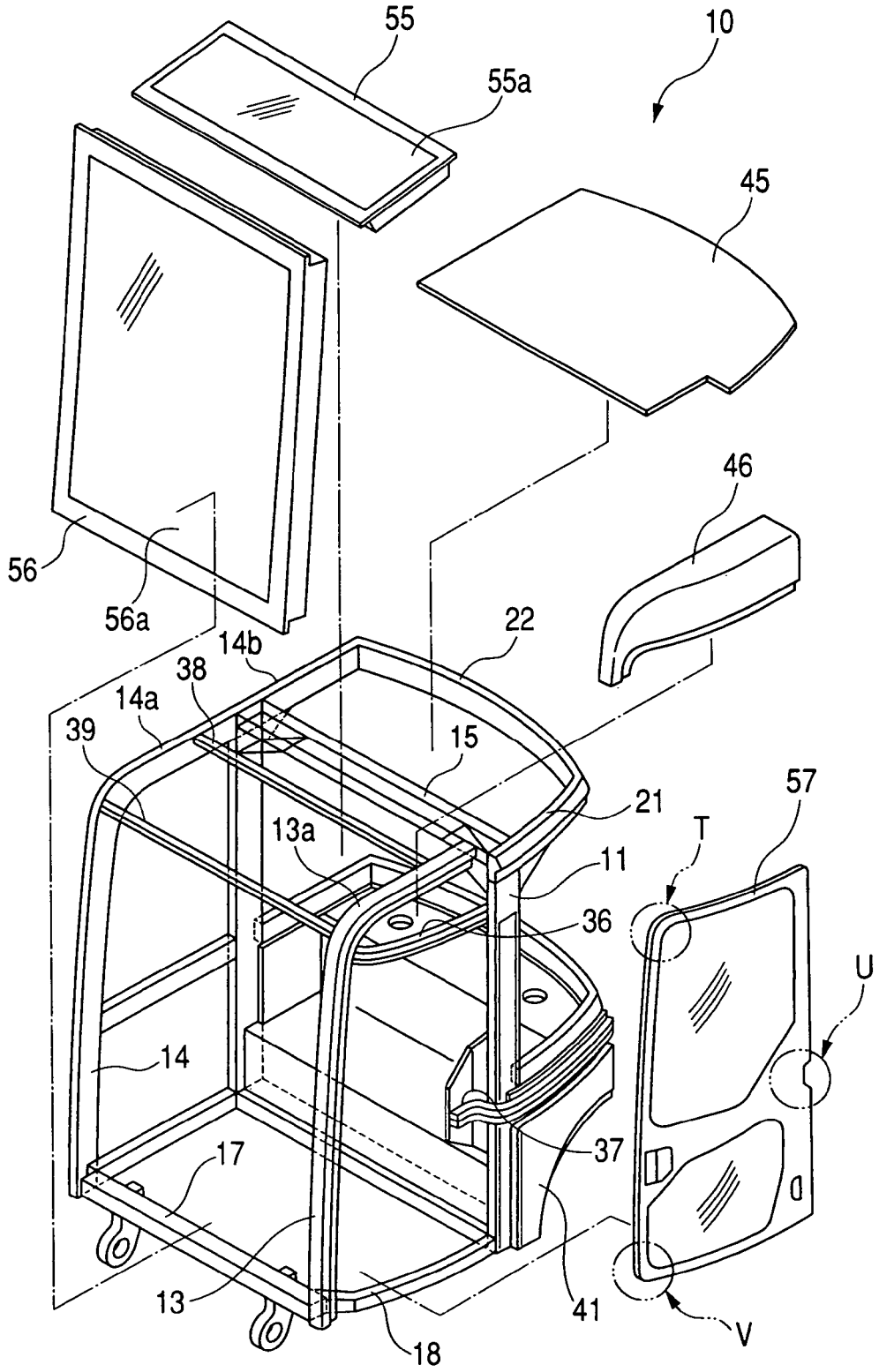
FIG. 6 is a third perspective view illustrating a cab of the invention.

In FIG. 6, crosspieces 39 and 38 are respectively disposed between the upper portion of the outer front pillar 13 and the upper portion of the inner front pillar 14, and between beam portion 13*a* and beam portion 14*a*. A roof plate 45 is mounted in the space surrounded by the crosspiece 38, frames 21, 22, and extension portion 14*b*. A sash 55 having a windowpane 55*a* is fitted in the space surrounded by the crosspieces 38, 39 and beam portions 13*a*, 14*a*. A sash 56 having a windowpane 56*a* is fitted in the space surrounded by the crosspiece 39, pillars 13, 14, and frame 17.

On the outer side surface of the cab 10, an upper guide rail 36 is mounted between upper portions of the outer central pillar 11 and outer front pillar 13. An intermediate guide rail 37 is mounted on the outer surface of the outer casing plate 41. The frame 18 acting also as the aforementioned lower guide rail (FIG. 3) is mounted between lower portions of the outer central pillar 11 and outer front pillar 13: A guide roller (not shown) mounted to the inside of the front upper portion T of the sliding door 57 is engaged on the upper guide rail 36. A guide roller (not shown) mounted to the inside of a rear portion U midway up the sliding door 57 is mounted on the intermediate guide rail 37. A guide roller (not shown) mounted to the inside of the front lower portion V of the sliding door 57 is engaged on the lower guide rail 18. This permits the sliding door 57 to be slidable along the outer side surface of the cab 10. A cover 46 having a three-dimensional curved surface is mounted between the upper guide rail 36 and beam portion 13*a*.

Figure 7:
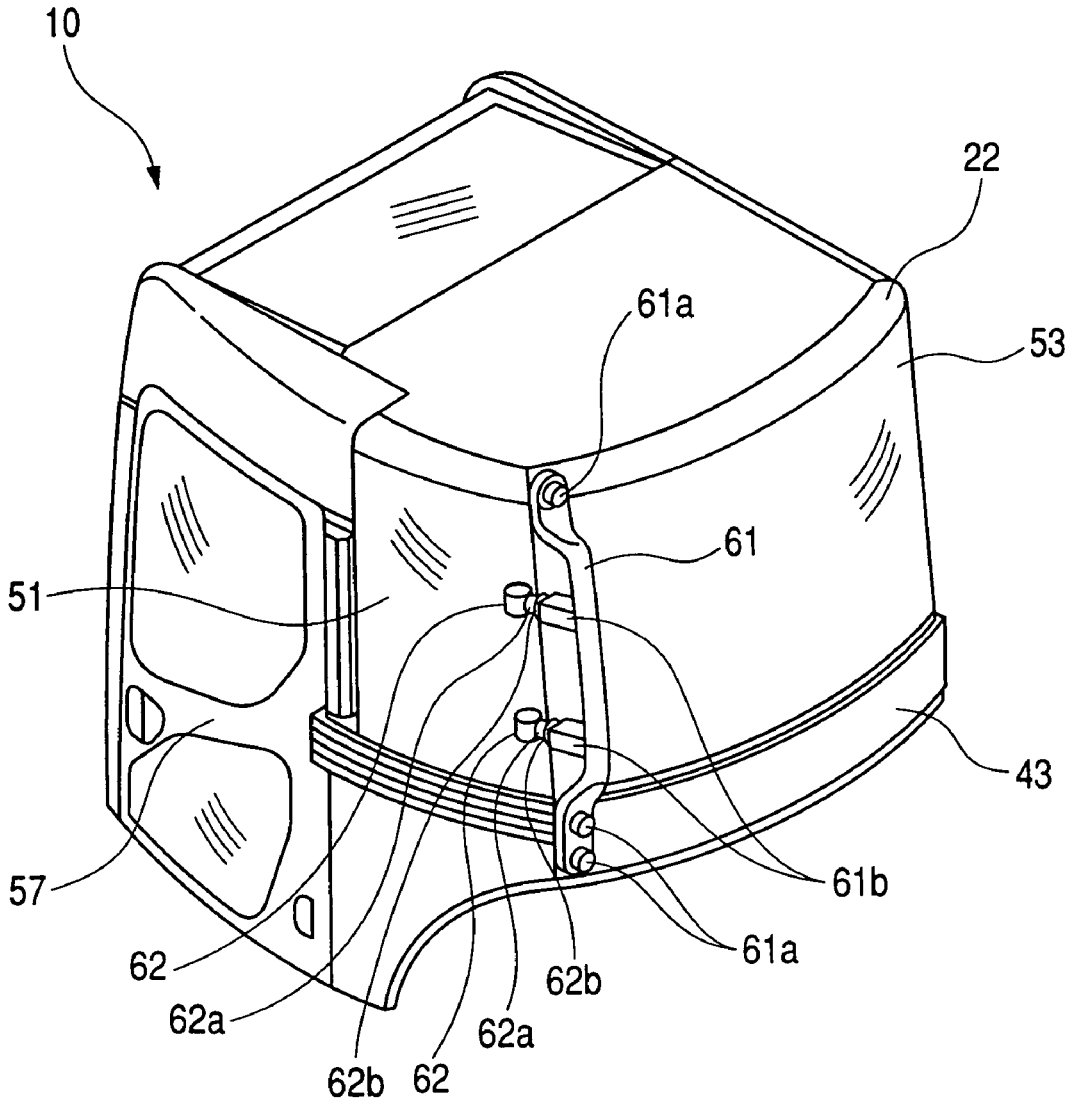
FIG. 7 is a fourth perspective view illustrating a cab of the invention.
Figure 8:
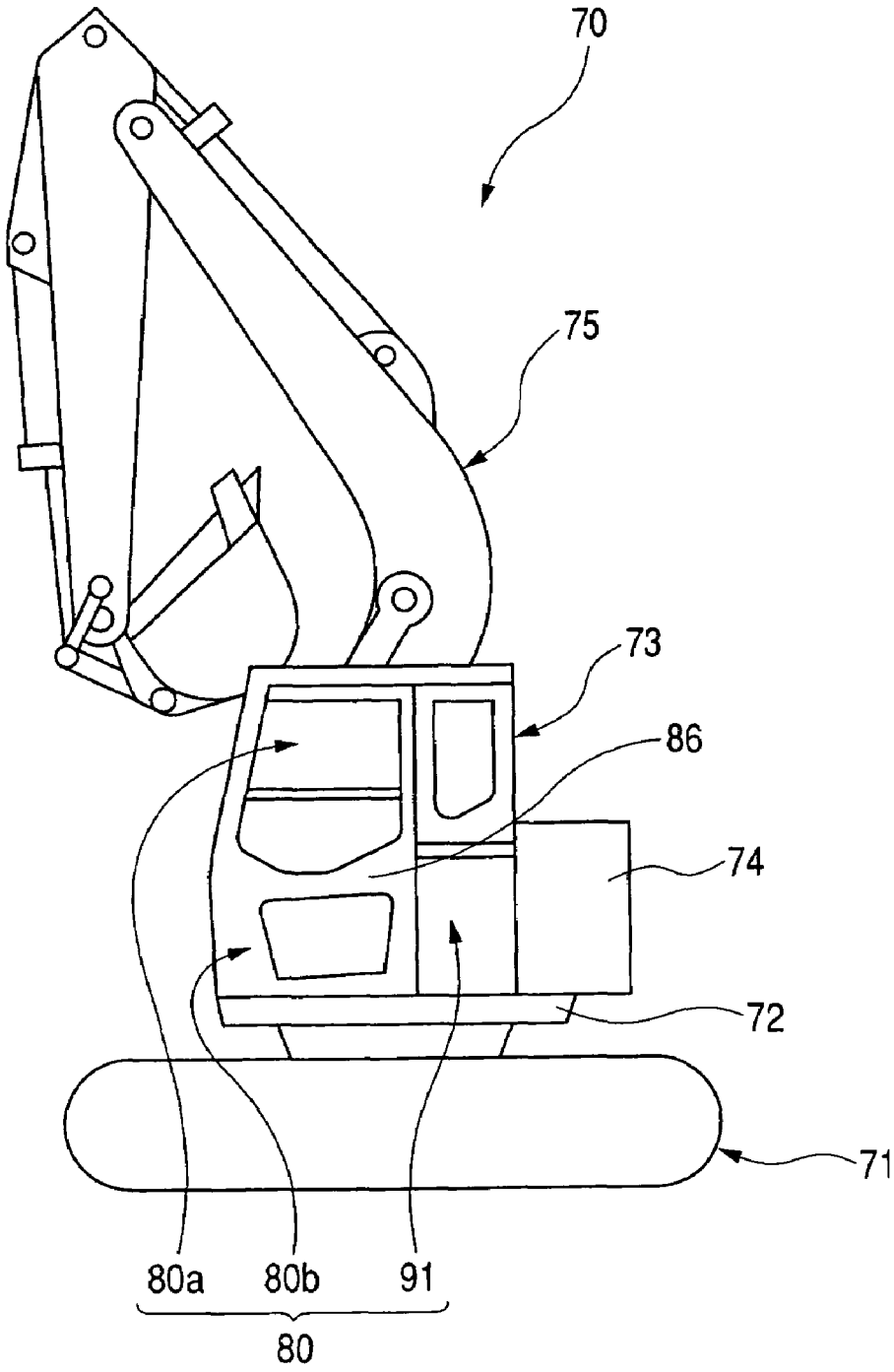
FIG. 8 PRIOR ART
FIG. 8 is a side elevation of a hydraulic shovel to which a cab associated with the prior art is applied.
Figure 9:
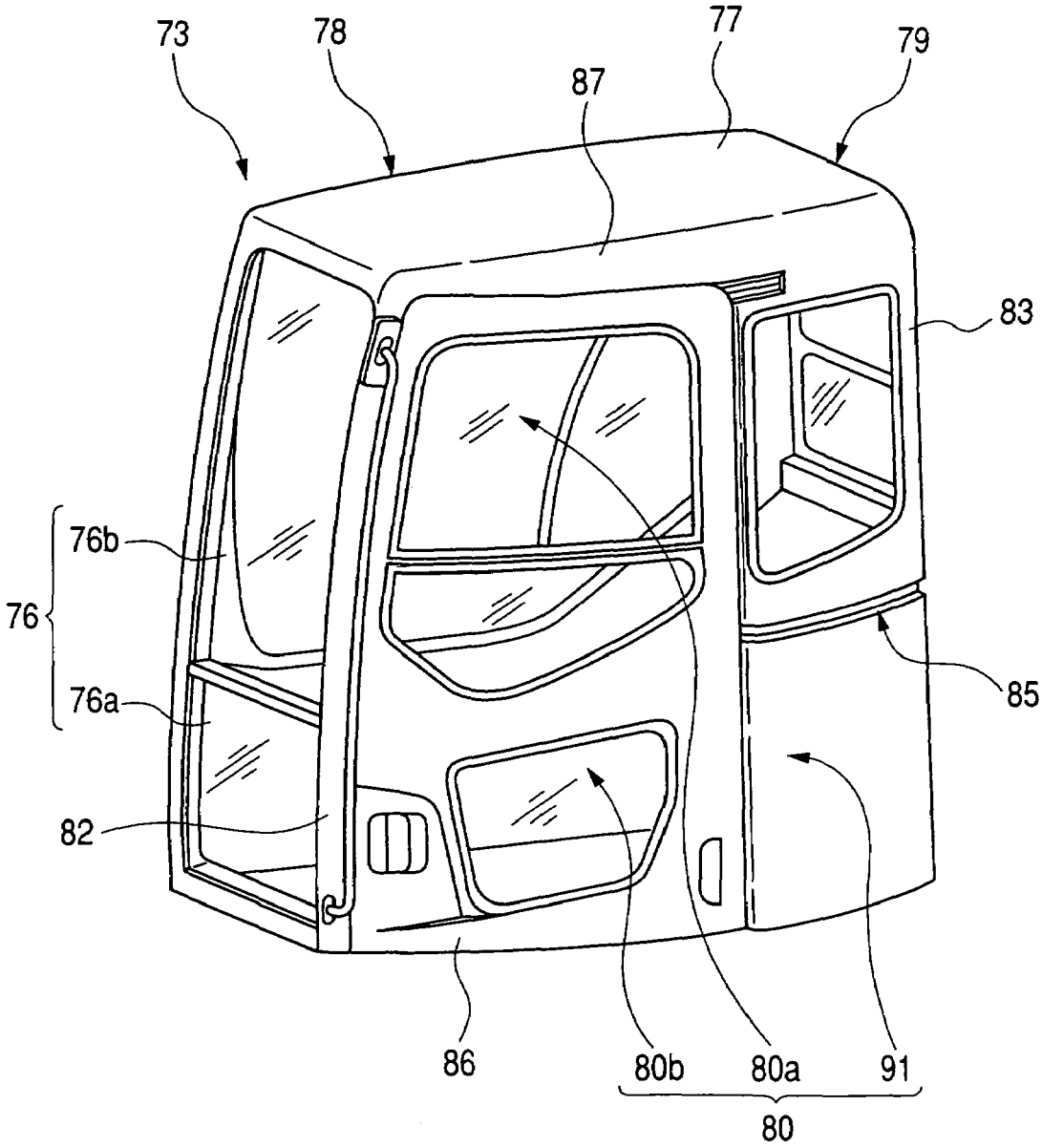
FIG. 9 PRIOR ART
FIG. 9 is a perspective view showing the structure of the cab associated with the prior art, showing the state in which the sliding door is closed.
Figure 10:
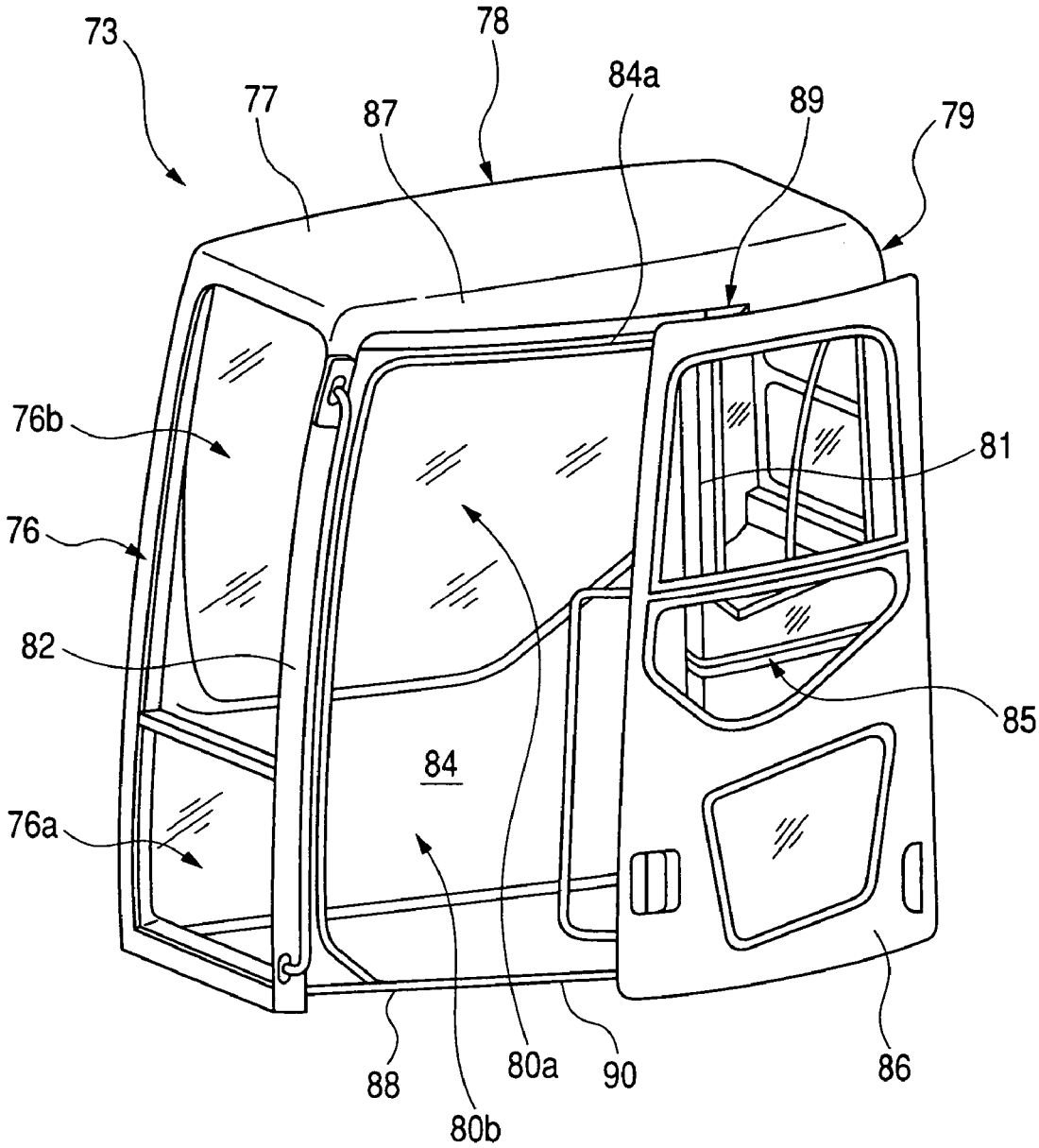
FIG. 10 PRIOR ART
FIG. 10 is a perspective view showing the structure of the cab associated with the prior art, showing the state in which the sliding door is opened.

In FIG. 7, a pipe member 61 in the up-and-down direction has its end portions mounted between the upper frame 22 and the lower outer casing plate 43 with bolts 61*a* near the corner portion between the outer side surface portion of the cab 10 and the rear surface portion. Threaded hole bosses 61*b* are rigidly welded to portions midway up the pipe member 61. Stopper rubber portions 62 have threaded portions 62*a* which are screwed in the threaded hole bosses 61*b* and fixed with lock nuts 62*b*. The pipe member 61 and stopper rubber portions 62 are placed in positions where they stay within the outer width B of the machine body if the turntable 3 rotates. In this way, the pipe member 61 acts also as a handrail assisting access to and from the construction machine 1. When the sliding door 57 opens, the pipe member 61 serves also as a stopper. The pipe member 61 may be made of a rodlike member, for example.

Because of the construction of FIGS. 1-7, the following operations and effects are obtained.

(1) Since the pillars forming the cab 10 are made up of the four pillars (front and rear, and left and right) including outer central pillar 11 mounted in the outer side portion where it bulges outward and the inner central pillar 12. Therefore, the sliding door 57 can be mounted without mounting the prior art intermediate pillar. Accordingly, the cab 10 having the sliding door 57 can be fabricated at low cost. Furthermore, the cab can be formed into a rigid, three-dimensional box structure by the four pillars at front and rear and left and right. Moreover, pillars are mounted in the center position opposite each other in the left-and-right direction. The center position of the outer side surface portion bulges outwardly and so is most likely to receive great external force if the construction machine rolls over. Therefore, a cab of the structure having rollover protection strength can be constructed.

(2) The pillars of the cab 10 are made up of the four pillars, i.e., the outer central pillar 11 disposed in the outer side portion where it bulges outward, the inner central pillar 12, and the outer front pillar 13 and inner front pillar 14 disposed at the left and right corner portions at the front end of the cab. Consequently, no pillars are disposed at the corner portions in the left and right of the rear end of the cab 10. Therefore, the windows 51, 52, and 53 in the rear portion of the cab 10 can be enlarged. This can improve the rearward visibility of the cab 10.

(3) The upper portions of the outer central pillar 11 and inner central pillar 12 are coupled by a beam at the longitudinal center of the cab 10, forming the gate-shaped rollover guard 15A and, therefore, the cab 10 having rollover protection strength can be constructed at low manufacturing cost.

(4) Because of the result of (3) above, the rear-end portions of the beam portions 13*a* and 14*a* can be coupled to the horizontally extending beam portion 15 of the rollover guard 15A, the beam portions 13*a* and 14*a* being formed by bending the upper-end portions of the outer front pillar 13 and inner front pillar 14 rearward in a two-dimensional manner. Thus, a simple rigid box structure can be formed, though the rear end of the beam portion 13*a* and the upper end of the outer central pillar 11 are misaligned with each other in the left-and-right direction because the beam portion 13*a* is formed by bending the upper-end portion of the outer front pillar rearward in a two-dimensional manner. The structures of the outer front pillar 13 and inner front pillar 14 can be simplified. The cab 10 can be fabricated at low manufacturing cost.

(5) The rigid, three-dimensional frame (box structure) is formed in the front portion of the cab 10 by the outer front pillar 13, inner front pillar 14, beam portions 13*a*, 14*a*, and rollover guard 15A. Therefore, if the construction machine 1 rolls over, the necessary space can be secured within the cab 10.

(6) The body of the U-shaped frame consisting of the frames 21, 22, and beam portion extension portion 14*b* is mounted between the upper-end portions of the outer central pillar 11 and inner central pillar 12, i.e., on the rear side of the upper-end portion of the rollover guard 15A, and directed rearward. The left and right leg portions are firmly secured. Thus, the U-shaped rear roof frame 22A is formed. Consequently, the crash-resistant strength of the rear portion of the cab can be improved if the construction machine 1 rolls over. The necessary space can be secured within the cab 10 with greater certainty.

(7) If the pillars at desired positions are fabricated from pipes, the strengths of these portions can be improved. Both the outer central pillar 11 and inner central pillar 12 are made of a rigid pipe. The upper portions of the pillars 11 and 12 are coupled by the beam 15 made of a rigid pipe. Therefore, the rigid gate-shaped rollover guard 15A can be formed at the longitudinal center of the cab 10. This can further improve the crush resisting strength of the cab 10 if the construction machine 1 rolls over.

(8) Since the pillars 13, 14 and frames 21, 22 are made of pipes of special cross section, adhering of the windowpanes 51, 52, and 53, fitting of the sash 54, abutment of the sliding door 57, and so on can be carried out with good aesthetic appearance without using any other member. As a consequence, the cab 10 can be fabricated at low manufacturing cost.

(9) The U-shaped rear roof frame 22A is fixedly mounted between the upper-end portions of the left and right rear pillars (in the embodiment, the outer central pillar 11 and inner central pillar 12) among the four pillars, and directed rearward. Therefore, the roof portion of the rear portion of the cab 10 is also reinforced. Consequently, the crush-resisting strength of the rear portion of the cab if the construction machine 1 rolls over can be improved. Thus, if the construction machine 1 rolls over, deformation of the cab 10 can be reduced, and a larger space can be secured inside the cab 10 with greater certainty.

(10) The pipe member 61 is mounted in the up-and-down direction near the corner portion where the outer side portion and rear portion meet, and is used as a hand rail assisting access to and from the construction machine 1. Stopper rubber portions 62 acting as stoppers when the sliding door 57 opens are mounted to the pipe member 61. Consequently, the body of the cab 10 is made simpler in construction. The cab 10 can be fabricated at low manufacturing cost.

(11) The cab 10 is constructed so that it is supported via the anti-vibration bushings 65 and anti-vibration members 66 and so that when great external force is applied to the cab 10, the lower-end surfaces E, F, G, and H of the pillars 11, 12, 13, and 14 of the cab 10 come into abutment with the turntable 3. Thus, transmission of vibrations from the turntable 3 to the cab 10 and transmission of sound conducted through solid matter can be cut off by the anti-vibration bushings 65 and anti-vibration members 66. Therefore, during normal times, the cab 10 providing a quiet, comfortable ride can be realized, and if the construction machine 1 rolls over, the cab 10 has rigidity.

In the above structure, an example in which the pillars 11, 12, 13, and 14 of the cab 10 are each made of a pipe has been described. However, the invention is not limited to this. The pillars may be formed by forming inner plates in which vertically extending channels are formed, for example, by press molding such as in well-known press-molded cabs and adhering outer plates (none of which are shown) to the inner plates by spot welding or the like. Alternatively, plates may be bent into pillar-like form (not shown) to form the pillars. Meanwhile, the anti-vibration bushings 65 and anti-vibration member 66 are shown as examples of anti-vibration support of the cab 10. The invention is not limited to this. Other anti-vibration means may be used. Also, the pillars 11, 12, 13, and 14 may be directly fixed to the turntable 3.

Because of the results described so far, in the cab of the construction machine fitted with the sliding door in the outer side surface portion that is installed in a position offset from the center of rotation of the turntable rotatably mounted on the traveling gear, and with the outer side portion formed to have an outwardly bulging curved surface, a cab of the construction machine having rollover protection strength can be easily fabricated at low manufacturing cost.

In the description of the embodiments described so far, the cab for the hydraulic shovel is taken as an example. The present invention is not limited to a hydraulic shovel. The invention can be universally applied to the cab of other construction machines such as a rough terrain crane. Operations and effects similar to the foregoing can be obtained.

What is claimed is:

1. A cab in a construction machine, comprising the cab being mounted on a turntable in a position offset from a rotational center of the turntable, the turntable being mounted on a traveling gear; a sliding door being provided at an outer side portion at a left side of the cab, the sliding door being formed to have a curved surface bulging outward, the cab comprising:

four pillars in total, the four pillars including:

an outer central pillar being provided at a center portion of the cab and forming the center portion on the left side of the outer side portion of the cab, the outer central pillar having a shape bulging outward within a radius of rotation of the turntable, an inner central pillar being provided at an inner side portion of the cab and located opposite to the outer central pillar, the outer central pillar and the inner central pillar respectively being provided at left and right sides of the cab, and an outer front pillar and an inner front pillar being provided at a left and a right corner portions at a front end of the cab;

first and second frames extending rearward from respective middle positions of the outer central pillar and the inner central pillar, and an outer-outer casing plate and an inner-outer casing plate respectively being attached to the first and second frames, the outer-outer casing plate and the inner-outer casing plate respectively supporting the first and second frames;

a third frame connecting respective end portions of the first and second frames; the first, second and third frames forming a rear portion of the cab;

an upper guide rail being attached between respective upper portions of the outer central pillar and the outer front pillar;

an intermediate guide rail being attached to an outer surface of the outer-outer casing plate, and a lower guide rail being attached between respective lower portions of the outer central pillar and the outer front pillar; and the sliding door engaging with the upper guide rail, the intermediate guide rail and the lower guide rail enabling the slide door to slide along an outer side surface of the cab.

2. The cab in a construction machine as set forth in claim 1, wherein at least one of the four pillars is made of a pipe.

3. The cab in a construction machine as set forth in claim 1, wherein the four pillars constitute a protection system for protecting an operator if the construction machine rolls over.

4. The cab in a construction machine as set forth in claim 1, wherein a U-shaped frame is firmly mounted between upper end portions of the outer central pillar and the inner central pillar to form a U-shaped rear roof frame that extends over the rear portion of the cab.

5. The cab in a construction machine as set forth in claim 2, wherein (A) the outer front pillar at the front end of the outer side portion of the cab is formed from the pipe, (B) an upper end portion of the outer front pillar is bent rearward in a two-dimensional manner to form a beam portion, and (C) a rear-end portion of the beam portion of the outer front pillar is coupled to an upper end of the outer central pillar via a beam member.

6. The cab in a construction machine as set forth in claim 1, wherein a pipe member or rod member extends in an up-and-down direction with both end portions thereof mounted near a corner portion of the cab where the outer side portion and a rear surface portion of the cab meet, and a stopper member stopping movement of the sliding door is mounted to the pipe member or the rod member.

7. The cab in a construction machine as set forth in claim 1, wherein the rear portion of the cab covers an engine of the construction machine.

* * * * *